US011075440B2

(12) United States Patent
Xia et al.

(10) Patent No.: US 11,075,440 B2
(45) Date of Patent: Jul. 27, 2021

(54) SURFACE-MOUNTED DEVICE AND MOBILE TERMINAL

(71) Applicant: AAC Technologies Pte. Ltd., Singapore (SG)

(72) Inventors: Xiaoyue Xia, Shenzhen (CN); Zhimin Zhu, Shenzhen (CN); Wei Zhao, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 60 days.

(21) Appl. No.: 16/524,094

(22) Filed: Jul. 28, 2019

(65) Prior Publication Data

US 2020/0052373 A1 Feb. 13, 2020

(30) Foreign Application Priority Data

Aug. 12, 2018 (CN) ..... 201810919427.X

(51) Int. Cl.
*H01Q 1/22* (2006.01)
*H01Q 1/24* (2006.01)

(52) U.S. Cl.
CPC ..... *H01Q 1/2283* (2013.01); *H01Q 1/242* (2013.01)

(58) Field of Classification Search
CPC ..... H01Q 1/2283; H01Q 1/242; H01Q 1/243; H01Q 1/1207; H01Q 21/065; H01Q 21/29; H01Q 21/06; H01Q 23/00
See application file for complete search history.

(56) References Cited

U.S. PATENT DOCUMENTS 8,344,955 B2 * 1/2013 Niemi ..... H01Q 1/085 343/702
8,730,110 B2 * 5/2014 Rao ..... H01Q 9/0421 343/702
10,305,189 B2 * 5/2019 Ueda ..... H01Q 9/0407
10,324,502 B2 * 6/2019 Yazaki ..... H04R 9/06
10,455,065 B2 * 10/2019 Lee ..... H01Q 21/062
(Continued)

FOREIGN PATENT DOCUMENTS

CN 103367917 B2 10/2013
CN 104124527 B2 10/2014
(Continued)

OTHER PUBLICATIONS

PCT search report dated Aug. 8, 2019 by SIPO in related PCT Patent Application No. PCT/CN2019/088744 (4 Pages).
(Continued)

*Primary Examiner* — Haissa Philogene
(74) *Attorney, Agent, or Firm* — W&G Law Group LLP

(57) ABSTRACT

The present disclosure provides a surface-mounted device and a mobile terminal. The surface-mounted device includes a rigid-flex board, at least one antenna array provided at the rigid-flex board; and a radio frequency integrated chip packaged in the rigid-flex board and connected to the at least one antenna array. The surface-mounted device can be welded to a main board of the mobile terminal as a separate device, making the installation convenient. Moreover, an omnidirectional coverage can be achieved when two opposite corners of the mobile terminal are respectively provided with one surface-mounted device.

15 Claims, 8 Drawing Sheets

(56) References Cited

U.S. PATENT DOCUMENTS

| | | | | |
|---|---|---|---|---|
| 10,547,108 | B2 * | 1/2020 | Jeon | H01Q 1/24 |
| 10,950,945 | B2 * | 3/2021 | Onaka | H01Q 19/005 |
| 2019/0229405 | A1 * | 7/2019 | Xia | H01Q 21/205 |

FOREIGN PATENT DOCUMENTS

| | | | |
|---|---|---|---|
| CN | 107785655 | A1 | 3/2018 |
| CN | 108376828 | A1 | 8/2018 |
| CN | 109149070 | A1 | 1/2019 |

OTHER PUBLICATIONS

1st Office Action dated Jan. 3, 2020 by SIPO in related Chinese Patent Application No. 201810919427.X (42 Pages).

* cited by examiner

SURFACE-MOUNTED DEVICE AND MOBILE TERMINAL

TECHNICAL FIELD

The present disclosure relates to the field of antenna technologies, and in particular, to a surface-mounted device and a mobile terminal.

BACKGROUND

In wireless communication devices, there is always a device that radiates electromagnetic energy into space and receives electromagnetic energy from space, and this device is an antenna. The role of the antenna is to transmit a digital or analog signal modulated onto a radio frequency (RF) frequency to a spatial wireless channel, or to receive a digital or analog signal modulated onto the RF frequency from a spatial wireless channel.

With 5G being the focus of research and development in the global industry, developing 5G technologies and formulating 5G standards have become the industry consensus. International Telecommunication Union (ITU) identified the main application scenarios for 5G in the ITU-RWPSD 22nd meeting held in June 2015. ITU defined three main application scenarios: enhance mobile broadband, large-scale machine communication, and highly reliable low-latency communication. The above three application scenarios respectively correspond to different key indicators, and in the enhance mobile broadband scenario, the user peak speed is 20 Gbps and the minimum user experience rate is 100 Mbps. In order to meet these demanding indicators, several key technologies will be adopted, including millimeter wave technology.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are caused to distribute according to certain regularity by a phase shifter, so that a high gain beam is formed and the beam is scanned over a certain spatial range through a change in phase shift. In future mobile phones, small space will be reserved for the 5G antenna, and there are not many optional positions, so an antenna solution with high space utilization and excellent performance in a complicated environment is needed.

Therefore, it is necessary to provide a new antenna module to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Embodiment 1

Figure 1:
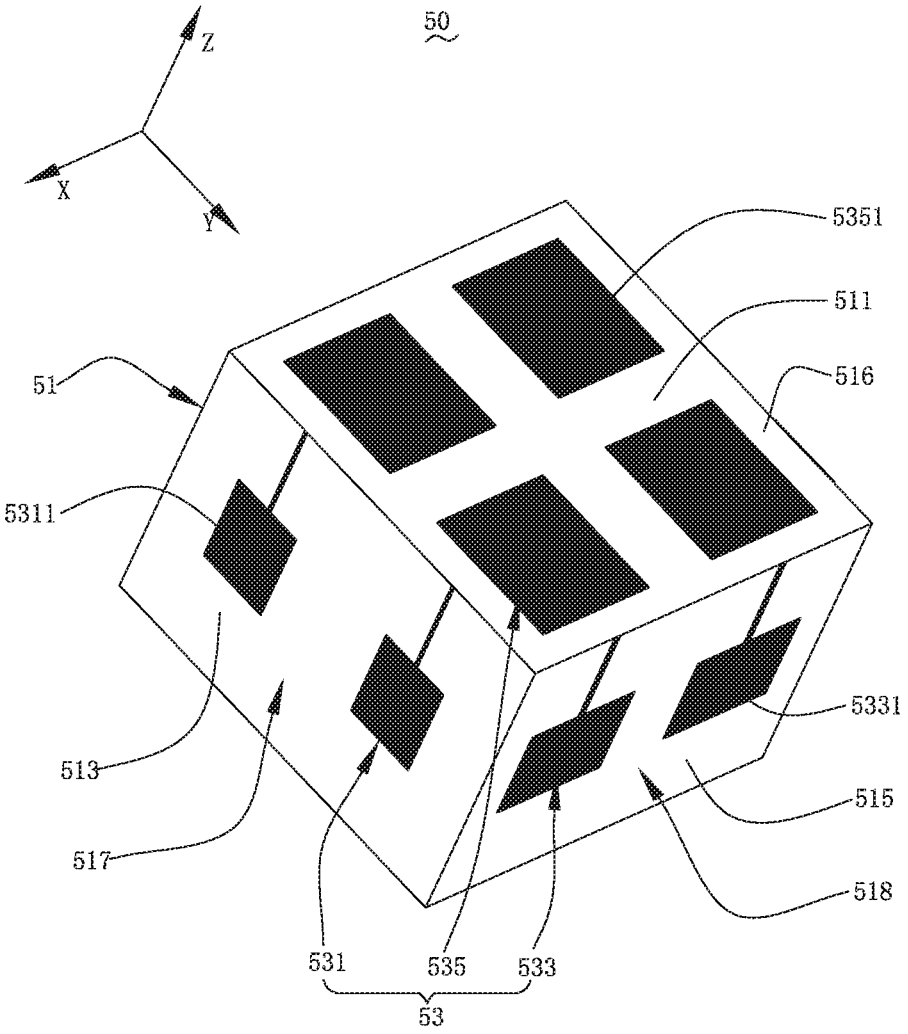
FIG. 1 is a structural schematic diagram of a surface-mounted device provided by the present disclosure.
Figure 2:
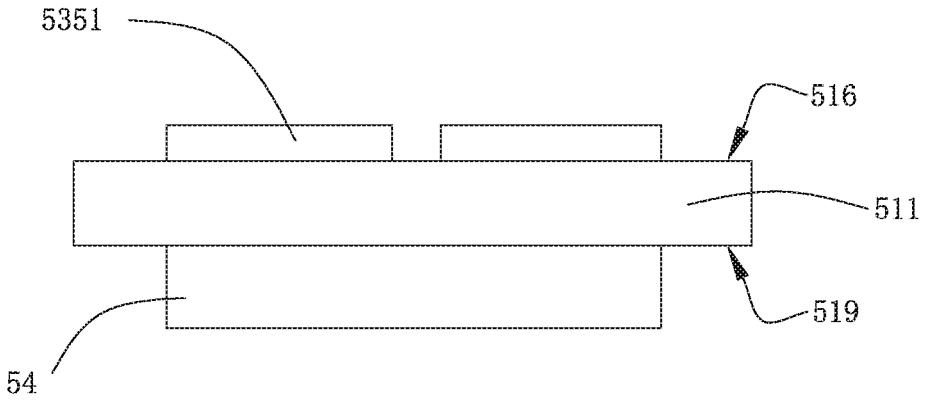
FIG. 2 is a partial structural schematic diagram of a surface-mounted device provided by the present disclosure.
Figure 3:
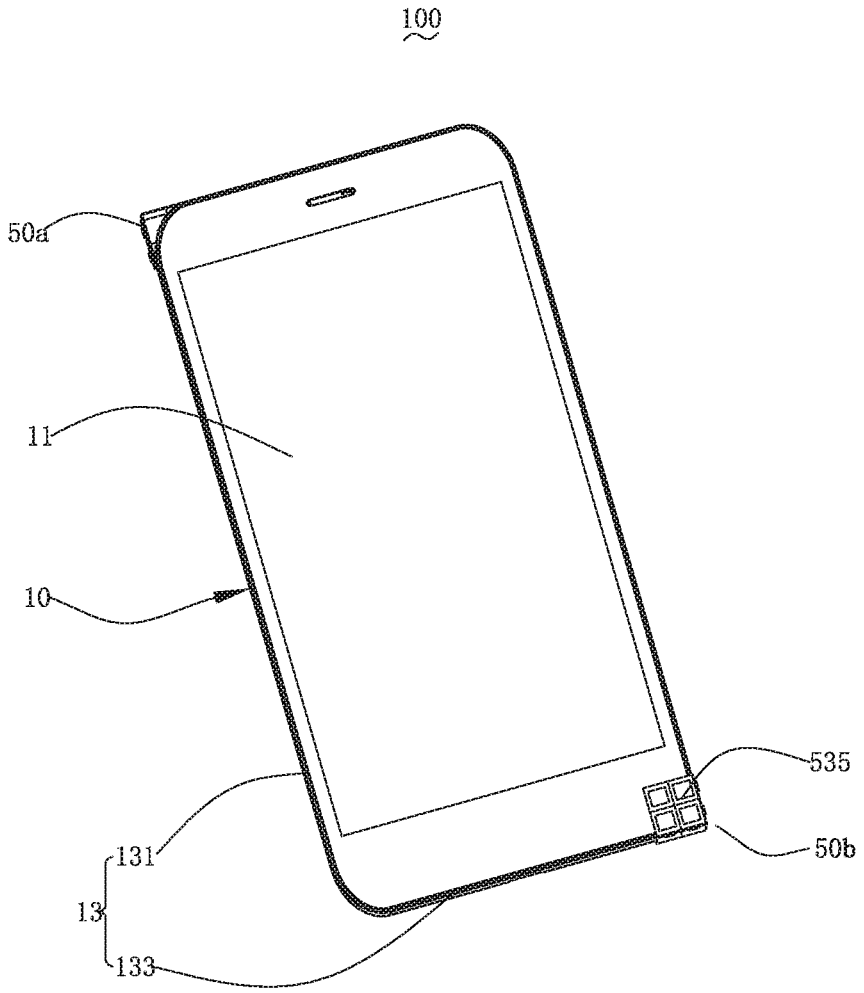
FIG. 3 schematically illustrates a layout position of a surface-mounted device applied to a mobile terminal provided by the present disclosure when viewed in one perspective.
Figure 4:
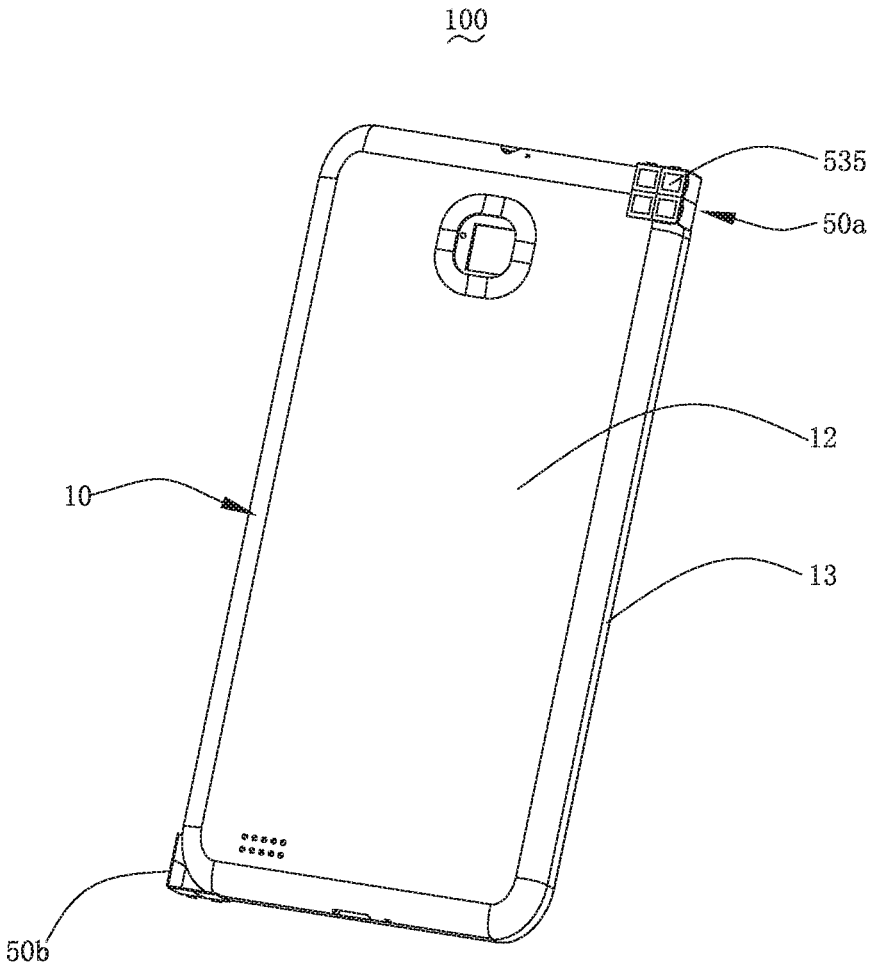
FIG. 4 schematically illustrates a layout position of a surface-mounted device applied to a mobile terminal provided by the present disclosure when viewed in another perspective.
Figure 5:
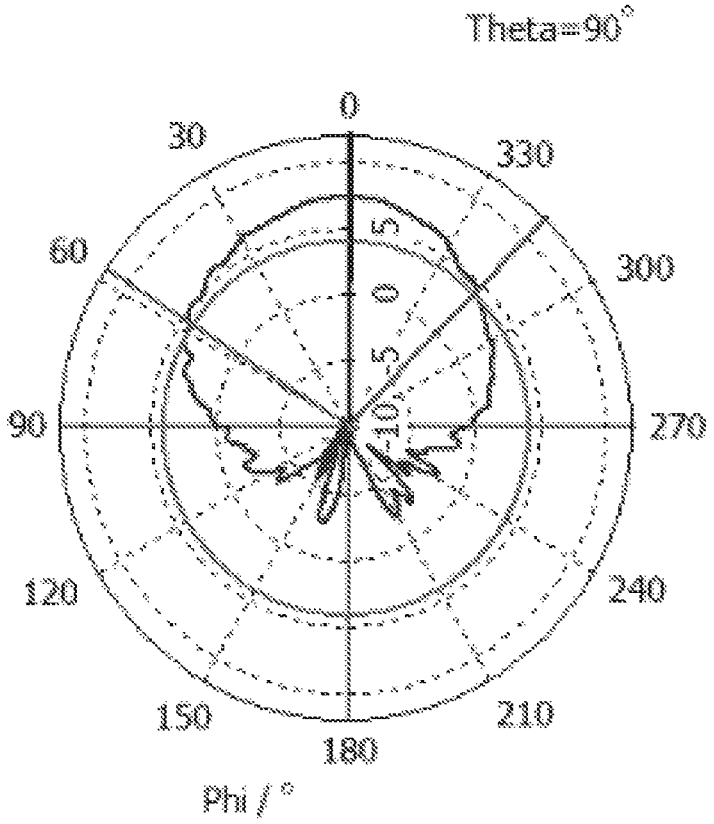
FIG. 5 illustrates a pattern of a first antenna array of the present disclosure in the case where respective antenna units are fed with power at equal amplitude and equal phase.

Referring to FIG. 1-2, the present disclosure provides a surface-mounted device 50 that can be applied as an antenna module to a mobile terminal.

The surface-mounted device 50 includes a rigid-flex board 51, an antenna array 53 provided at the rigid-flex board 51, and a radio frequency integrated chip 54 packaged in the rigid-flex board 51 and connected to the antenna array 53.

The rigid-flex board 51 includes a first portion 511, and a second portion 513 and a third portion 515 that are respectively bent and extend from two side edges of the first portion 511. When the rigid-flex board is not pressed by an external force, the first portion 511, the second portion 513 and the third portion 515 are perpendicular to each other and enclose a receiving space. The radio frequency integrated chip 54 is packaged in the receiving space. It should be noted that when the surface-mounted device 50 is applied to a mobile terminal, a shape of the rigid-flex board 51 needs to be deformed accordingly in order to adapt to the shape of the housing of the mobile terminal. Moreover, the rigid-flex board 51 may further include a fourth portion arranged opposite to the first portion or a fifth portion arranged opposite to the second portion or a sixth portion arranged opposite to the third portion, which is not limited here, but the rigid-flex board 51 includes at least the first portion 511, the second portion 513 and the third portion 515.

The antenna array 53 includes a first antenna array 531 provided at the second portion 513, a second antenna array 533 provided at the third portion 515, and a third antenna array 535 provided at the first portion 511. Specifically, the first antenna array 531, the second antenna array 533, and the third antenna array 535 are respectively provided at an outer surface of the second portion 513, an outer surface of the third portion 515, and an outer surface of the first portion 511. Here, an outer surface refers to a surface that faces away from the receiving space.

As an example, each of the first antenna array 531, the second antenna array 533, and the third antenna array 535 is a phased array antenna array.

Embodiment 2

Referring to FIG. 1 to FIG. 4, the present disclosure provides a mobile terminal 100, and the mobile terminal 100 may be a mobile phone, a tablet computer, a multimedia player, or the like. For ease of understanding, the following embodiments will be described by taking a smart phone as an example.

The mobile terminal 100 includes a housing 10, a main board received in the housing 10, and two surface-mounted devices 50 attached to an inside surface of the housing 10.

The housing 10 includes a screen 11, a back cover 12 that is opposite to and spaced apart from the screen 11, and a sidewall 13 that connects the screen 11 with the back cover 12. The sidewall 13 includes two long sidewalls 131 arranged opposite to each other and two short sidewalls 133 arranged opposite to each other and connecting the two long sidewalls 131. The housing 10 may be a curved glass screen made of glass, which can minimize the influence on the electromagnetic waves radiated by the surface-mounted device 50, thereby reducing the space loss of the electromagnetic waves.

The two surface-mounted devices 50 are fixed at the corners of the main board, located at opposite corners of the mobile terminal 100, and fixed to the main board by welding. Specifically, the surface-mounted device 50 is welded to the main board by a Ball Grid Array (BGA) package technology.

The surface-mounted device 50 includes a rigid-flex board 51, an antenna array 53 provided at the rigid-flex board 51, and a radio frequency integrated chip 54 packaged in the rigid-flex board 51 and connected to the antenna array 53.

The rigid-flex board 51 includes: a first portion 511; a second portion 513 and a third portion 515 that are respectively bent and extend from two side edges of the first portion 511; a first surface 516, a second surface 517 and a third surface 518 respectively located at the first portion 511, the second portion 513 and the third portion 515; and a top surface 519 of the first portion 511 arranged opposite to the first surface 516. The first surface 516 and the top surface 519 are opposite to the main board. The second surface 517 is opposite to the short sidewall 133. The third surface 518 is opposite to the long sidewall 131.

When the rigid-flex board is not pressed by an external force, the first portion 511, the second portion 513, and the third portion 515 are perpendicular to each other and enclose a receiving space, and the radio frequency integrated chip is packaged in the receiving space. Specifically, the radio frequency integrated chip is packaged at the top surface 519. It should be noted that when the surface-mounted device 50 is mounted on the main board and received in the housing 10, the shape of the rigid-flex board 51 needs to be deformed accordingly in order to adapt to the design of the shape of the housing 10. Moreover, the rigid-flex board 51 may further include a fourth portion arranged opposite to the first portion or a fifth portion arranged opposite to the second portion or a sixth portion arranged opposite to the third portion, which is not limited here, but the rigid-flex board 51 includes at least the first portion 511, the second portion 513, and the third portion 515.

The antenna array 53 includes a first antenna array 531 provided at the second portion 513, a second antenna array 533 provided at the third portion 515, and a third antenna array 535 provided at the first portion 511. Specifically, a first antenna array 531 is provided at the second surface 517, and the second antenna array 533 is provided at the third surface 518. The third antenna array 535 is provided at the first surface 516.

For convenience of description, the two surface-mounted devices 50 differentiate into a first surface-mounted device **50*a* and a second surface-mounted device 50*b*. In the present embodiment, in the perspective of FIG. 3, the first surface-mounted device 50*a* is provided at an upper left corner of the mobile terminal 100, and the first portion 511 thereof is provided at a side of the main board facing towards the screen 11. The second surface-mounted device 50*b* is provided at a lower right corner of the mobile terminal 100, and the first portion 511 thereof is provided on a side of the main board facing towards the back cover 12**.

Specifically, the first antenna arrays 531 of the first surface-mounted device **50*a* and the second surface-mounted device 50*b* are each attached to an inside surface of the short sidewall 133. The first antenna array 531 of the first surface-mounted device 50*a* is used to radiate electromagnetic waves towards one of the short sidewalls, i.e., +X direction (front) and the first antenna array 531 of the second surface-mounted device 50*b* is used to radiate electromagnetic waves towards the other short sidewall, i.e., −X direction (back); the second antenna arrays 533 of the first surface-mounted device 50*a* and the second surface-mounted device 50*b* are each attached to an inside surface of the long sidewall 131. The second antenna array 533 of the first surface-mounted device 50*a* is used to radiate electromagnetic waves towards one of the long sidewalls, i.e., +Y direction (left) and the second antenna array 533 of the second surface-mounted device 50*b* is used to radiate electromagnetic waves towards the other long sidewall, i.e., −Y direction (right); the third antenna array 535 of the first surface-mounted device 50*a* is attached to the surface of the screen 11, so as to radiate electromagnetic waves towards the screen, i.e., +Z direction (up), and the third antenna array 535 of the second surface-mounted device 50*b* is attached to the surface of the back cover 12**, so as to radiate electromagnetic waves towards the back cover, i.e., −Z direction (down). Thus, omnidirectional coverage in six directions of up, down, left, right, front and back is achieved.

The first antenna array 531 includes a plurality of first antenna units 5311 arranged in an array along a direction parallel with the short sidewalls 133. The second antenna array 533 includes a plurality of second antenna units 5331 arranged in an array along a direction parallel with the long sidewalls 131. The third antenna array 535 includes four third antenna units 5351, any two of which are arranged to be symmetric to each other. In this embodiment, the number of the first antenna units 5311 and that of the second antenna units 5331 are both two. The first antenna array 531 and the second antenna array 533 are arranged in a line array, and occupy a small space.

In this embodiment, the first antenna unit 5331 and the second antenna unit 5333 are microstrip-fed patch antennas. The third antenna unit 5351 is a probe-fed patch antenna.

As an example, each of the first antenna array 531, the second antenna array 533, and the third antenna array 535 can be a phased array antenna array.

As an example, the radio frequency integrated chip is connected to the antenna array by the flip-chip bonding process.

In this embodiment, the RF integrated chip RFIC includes a power amplifier, a low noise amplifier, a power split network, a phase shifter, a switch and the like RF front end that can achieve a phased array function, and also includes a function of up-conversion and down-conversion.

Figure 6:
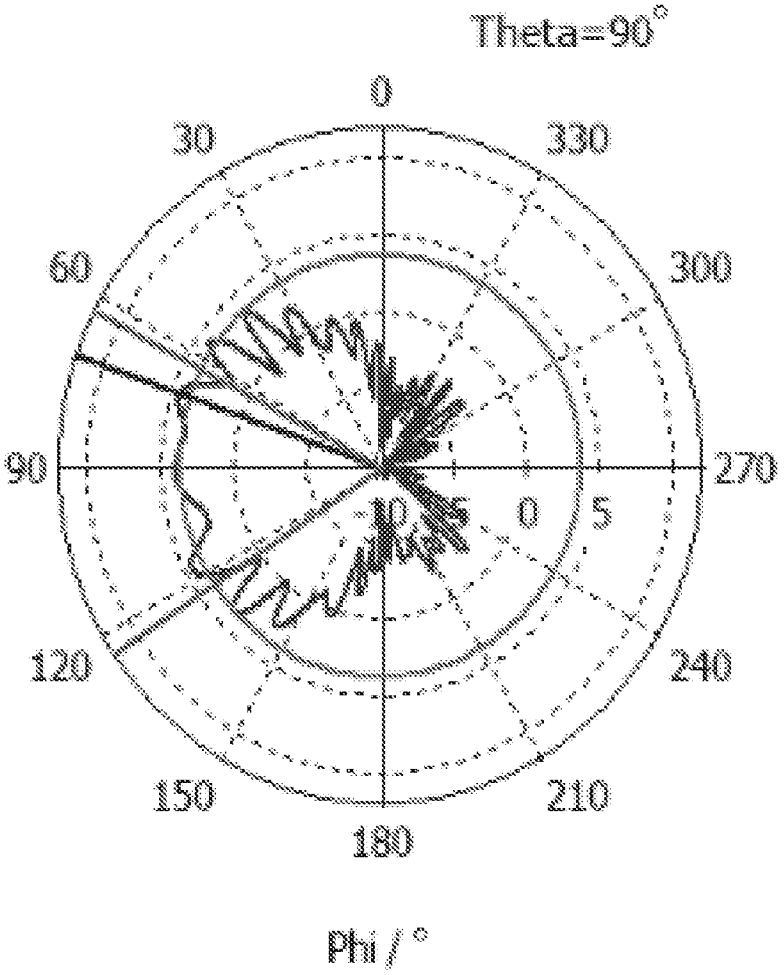
FIG. 6 illustrates a pattern of a second antenna array of the present disclosure in the case where respective antenna units are fed with power at equal amplitude and equal phase.
Figure 7:
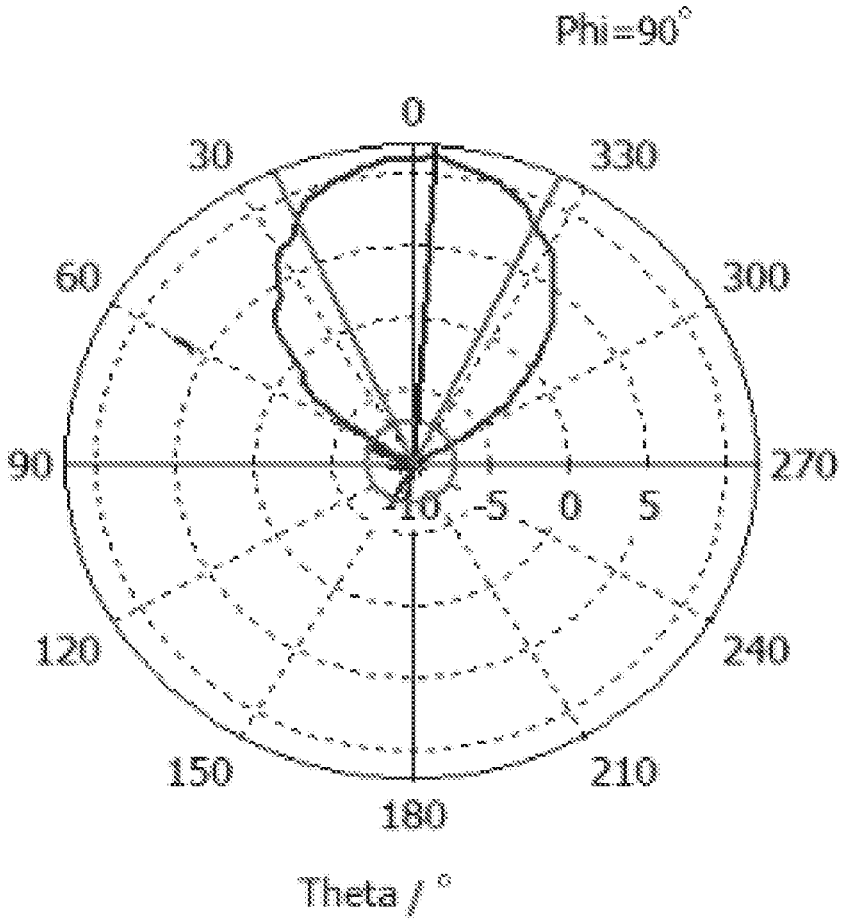
FIG. 7 illustrates a pattern of a third antenna array of the present disclosure in the case where respective antenna units are fed with power at equal amplitude and equal phase.
Figure 8:
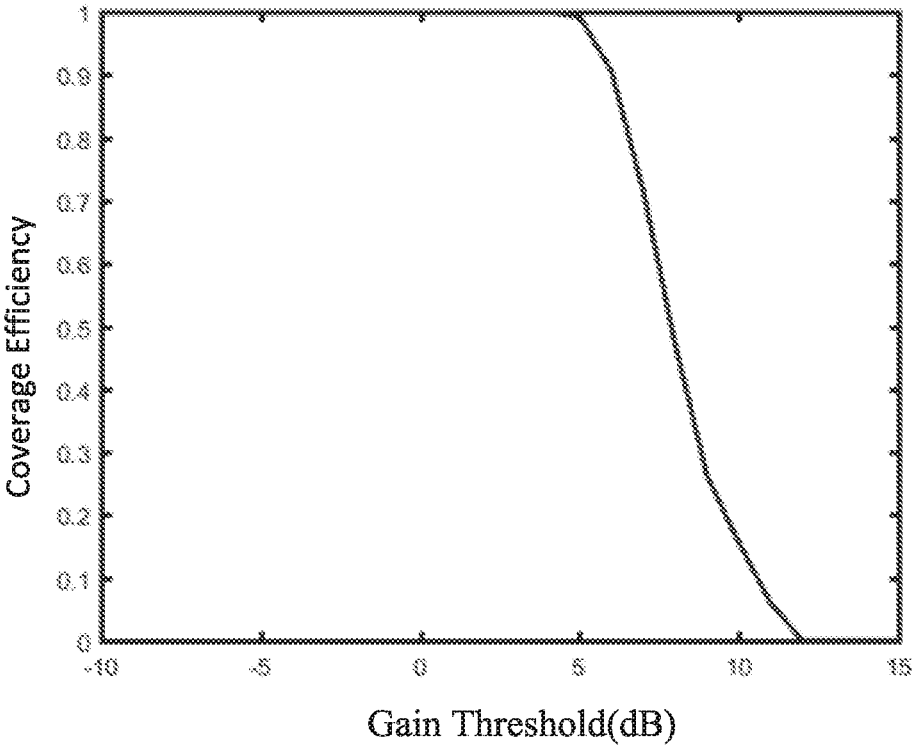
FIG. 8 illustrates a coverage efficiency graph of a mobile terminal provided by the present disclosure.

Referring to FIG. 5 to FIG. 8, FIG. 5 illustrates a pattern of a first antenna array of the present disclosure in the case where respective antenna units are fed with power at equal amplitude and equal phase; FIG. 6 illustrates a pattern of a second antenna array of the present disclosure in the case where respective antenna units are fed with power at equal amplitude and equal phase; FIG. 7 illustrates a pattern of a third antenna array of the present disclosure in the case where respective antenna units are fed with power at equal amplitude and equal phase; and FIG. 8 illustrates a coverage efficiency graph of a mobile terminal provided by the present disclosure. It can be seen from FIG. 8 that the antenna of the mobile terminal according to the present disclosure can have a high coverage efficiency.

The surface-mounted device and the mobile terminal provided by the disclosure have beneficial effects as follows. The surface-mounted device adopts the form of a rigid-flex board and an antenna-in-package, and can be welded to a main board of the mobile terminal as a separate device, making the installation convenient. The surface-mounted device includes a rigid-flex board, an antenna array provided on the rigid-flex board, and a radio frequency integrated chip packaged in the rigid-flex board and connected to the antenna array, and the first antenna array, the second antenna array, and the third antenna array of the antenna array are all provided on a surface of the rigid-flex board, such that close attachment to the housing can be achieved due to the flexibility of the rigid-flex board itself, thereby avoiding pattern distortion caused by the presence of air between the housing and the antenna and achieving the better mechanical stability so as not to result in damage, failure or performance deterioration of the antenna due to falling, oscillating and the like. Two surface-mounted devices are provided at the upper left corner and the lower right corner of the mobile terminal, respectively, and a first portion of one surface-mounted device is provided on a side of the main board facing towards the screen and a first portion of the other surface-mounted device is provided on a side of the main board facing towards the back cover, such that the three antenna arrays of the two surface-mounted devices can respectively radiating electromagnetic waves in six directions of up, down, left, right, front and back, thereby achieving omni-directional coverage and resulting in the extremely high coverage efficiency. The first antenna array, the second antenna array, and the third antenna array are all attached to the inside surface of a 3D glass cover, which can reduce the affection of a metal body in the mobile terminal on the radiation performance of the antenna and reduce the space loss of the electromagnetic waves. The first antenna array and the second antenna array that are facing towards the sidewall are both linear arrays, occupying a small space.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A surface-mounted device, comprising:

a rigid-flex board;

at least one antenna array provided at the rigid-flex board; and a radio frequency integrated chip packaged in the rigid-flex board and connected to the at least one antenna array;

wherein the rigid-flex board comprises a first portion, and a second portion and a third portion that are respectively bent and extend from two side edges of the first portion, at least one antenna array comprises a first antenna array provided at the second portion, a second antenna array provided at the third portion, and a third antenna array provided at the first portion, and when the rigid-flex board is not pressed by an external force, the first portion, the second portion and the third portion are perpendicular to each other and form a receiving space, and the radio frequency integrated chip is packaged in the receiving space.

2. A mobile terminal, comprising:

a housing;

a main board received in the housing; and two surface-mounted devices attached to an inside surface of the housing, the two surface-mounted devices being fixed at corners of the main board and located at opposite corners of the mobile terminal, wherein the surface-mounted device is the surface-mounted device as described in claim 1, and the housing comprises a screen, a back cover that is opposite to and spaced apart from the screen, and a sidewall that connects the screen with the back cover, a first portion of one of the two surface-mounted devices is provided at a side of the main board facing towards the screen, and the other surface-mounted device of the two surface-mounted devices is provided at a side of the main board facing towards the back cover, and the two surface-mounted devices are welded and fixed to the main board.

3. The mobile terminal as described in claim 2, wherein the sidewall comprises two long sidewalls arranged opposite to each other and two short sidewalls arranged opposite to each other and connecting the two long sidewalls, the first antenna arrays of the two surface-mounted devices respectively radiate electromagnetic waves towards the two short sidewalls, the second antenna arrays of the two surface-mounted devices respectively radiate electromagnetic waves towards the two long sidewalls, and the third antenna arrays of the two surface-mounted devices respectively radiate electromagnetic waves towards the screen and the back cover, so as to form an omnidirectional coverage.

4. The mobile terminal as described in claim 3, wherein a surface of the rigid-flex board facing towards the housing comprises a first surface, a second surface and a third surface respectively located at the first portion, the second portion and the third portion, the first surface is opposite to the main board, the second surface is opposite to one of the two short sidewalls, the third surface is opposite to one of the two long sidewalls, the first antenna array is provided at the second surface, the second antenna array is provided at the third surface, and the third antenna array is provided at the first surface.

5. The mobile terminal as described in claim 4, wherein the radio frequency integrated chip is packaged at a top surface of the first portion opposite to the first surface.

6. The mobile terminal as described in claim 4, wherein the first antenna array is attached to an inside surface of each of the two short sidewalls, the second antenna array is attached to an inside surface of each of the two long sidewalls, and the third antenna array is attached to an inside surface of the screen or an inside surface of the back cover.

7. The mobile terminal as described in claim 6, wherein the first antenna array comprises a plurality of first antenna units arranged in an array along a direction parallel with the two short sidewalls, the second antenna array comprises a plurality of second antenna units arranged in an array along a direction parallel with the two long sidewalls, the third antenna array comprises four third antenna units, any two of which are arranged to be symmetric to each other, the first antenna units and the second antenna units are microstrip-fed patch antennas, and the third antenna units are probe-fed patch antennas.

8. The mobile terminal as described in claim 7, wherein each of the first antenna array, the second antenna array and the third antenna array is a phased array antenna array.

9. The mobile terminal as described in claim 5, wherein the radio frequency integrated chip is connected to the at least one antenna array by a flip-chip bonding process.

10. The mobile terminal as described in claim 6, wherein the radio frequency integrated chip is packaged at a top surface of the first portion opposite to the first surface.

11. The mobile terminal as described in claim 7, wherein the radio frequency integrated chip is packaged at a top surface of the first portion opposite to the first surface.

12. The mobile terminal as described in claim 8, wherein the radio frequency integrated chip is packaged at a top surface of the first portion opposite to the first surface.

13. The mobile terminal as described in claim 12, wherein the radio frequency integrated chip is connected to the at least one antenna array by a flip-chip bonding process.

14. The mobile terminal as described in claim 10, wherein the radio frequency integrated chip is connected to the at least one antenna array by a flip-chip bonding process.

15. The mobile terminal as described in claim 11, wherein the radio frequency integrated chip is connected to the at least one antenna array by a flip-chip bonding process.

* * * * *